United States Patent [19]

Zavaras et al.

[11] 4,200,137

[45] Apr. 29, 1980

[54] PROCESS AND APPARATUS FOR THE CONTINUOUS CASTING OF METAL USING ELECTROMAGNETIC STIRRING

[75] Inventors: Alexander A. Zavaras, Athens, Greece; Robert Sobolewski, Streetsboro, Ohio; Robert E. Ryan, Highland Heights, Ohio; Michael J. George, Massillon, Ohio; Cecil B. Griffith, North Royalton, OH

[73] Assignee: Republic Steel Corporation, Cleveland, Ohio

[21] Appl. No.: 839,206

[22] Filed: Oct. 4, 1977

Related U.S. Application Data

[63] Continuation-in-part of Ser. No. 571,017, Apr. 22, 1975, abandoned.

[51] Int. Cl.[2] ..... B22D 27/02; B22D 11/10

[52] U.S. Cl. ..... 164/49; 164/82; 164/147; 164/437

[58] Field of Search ..... 164/49, 147, 250, 82, 164/437

[56] References Cited

U.S. PATENT DOCUMENTS

| | | | |
|---|---|---|---|
| 3,693,697 | 9/1972 | Tzavaras | 164/147 X |
| 3,811,490 | 5/1974 | Middleton et al. | 164/66 X |
| 4,042,007 | 8/1977 | Zavaras et al. | 164/147 X |

FOREIGN PATENT DOCUMENTS

| | | | |
|---|---|---|---|
| 173173 | 11/1960 | Sweden | 164/49 |

OTHER PUBLICATIONS

A .A. Tzavaras et al., "Cast Steel Structures Grown Under Fluid Flow," Journal of Crystal Growth, 13/14, 1972, pp. 782–786.

D. J. Hurtuk et al., "Some Effects of Electromagnetically Induced Fluid Flow on Macrosegregation in Continuous Cast Steel," 35 pp., presented at IMD Solidification Committee Meeting, Spring TMS–Aime Conference, Las Vegas, Nev., Feb. 1976.

*Primary Examiner*—Robert Louis Spruill
*Assistant Examiner*—Gus T. Hampilos
*Attorney, Agent, or Firm*—Cooper, Dunham, Clark, Griffin & Moran

[57] ABSTRACT

In continuous casting of metal in an open-ended mold through which the metal is advanced in a first direction while undergoing peripheral solidification, and to which molten metal is supplied by a shroud that opens beneath the metal level, the provision of electromagnetically produced metal circulation in the mold causing laminar flow of molten metal, in a second direction opposite to the first direction and at a rate not above 35 cm./sec., along the solid-liquid interface within the mold for preventing entrapment of inclusions at the interface.

14 Claims, 5 Drawing Figures

PROCESS AND APPARATUS FOR THE CONTINUOUS CASTING OF METAL USING ELECTROMAGNETIC STIRRING

CROSS-REFERENCE TO RELATED APPLICATION

This application is a continuation-in-part of applicants' copending U.S. patent application Ser. No. 571,017 filed Apr. 22, 1975 for Continuous Casting of Metal (now abandoned).

BACKGROUND OF THE INVENTION

This invention relates to procedures and apparatus for the continuous casting of metals.

More particularly, the invention is directed to continuous casting operations of the type wherein the metal being cast is progressively advanced through a chilled and open-ended mold while undergoing peripheral solidification to provide a solid outer shell for the emerging cast body, which typically has a molten core extending for some distance beyond the mold. Additional positive cooling is commonly applied to the body beyond the mold to promote solidification of the core. In the casting operations with which the present invention is most specifically concerned, molten metal is progressively supplied to the mold (as casting proceeds) from a tundish or the like through a so-called submerged shroud, i.e. a conduit or tube that has discharge ports submerged beneath the molten metal level in the mold.

A familiar example of such operations, to which detailed reference will be made herein for purposes of illustration, is the casting of steel billets in an axially vertical mold having a coaxially disposed shroud projecting downwardly into the mold.

In these and other casting operations, inclusions such as oxide particles are unavoidably present in the delivered molten metal. Desirably, the inclusions thus introduced are carried into the slag layer floating on the molten metal surface in the mold during casting. It is found, however, that even though the inclusions are lower in specific gravity than the metal, a proportion of them tend to become entrapped at the solid-liquid interface within the mold. Consequently, the cast billet may contain significant quantities of these inclusions, especially in its outer portion, which corresponds to the locus of the solidification front at the region within the mold where the entrapment occurs. Material from the slag layer may also be entrapped as inclusions in the outer portion of the billet. Apart from the general undesirability of incorporating contaminant matter in a cast billet, the occurrence of such inclusions, e.g..alumina, presents a serious specific problem in that it interferes with machinability of the billet, since the outer portion of the billet is commonly subjected to machining.

Stated in other words, it would be very desirable to minimize or prevent entrapment of inclusions, whether from the introduced flow of molten metal or from the slag layer, at the solid-liquid interface of a body being case within a continuous casting mold.

Various expedients have heretofore been suggested for dealing with these and other problems associated with conventional continuous casting practice. For instance, it has been proposed to provide a shroud having lateral discharge ports oriented to direct the flow of supplied molten metal obliquely upwardly within a mold. In operations not employing a shroud, it has also been proposed to deliver molten metal to the mold within a surrounding sleeve of inert gas, or to create, by electromagnetically produced molten metal circulation, an upward flow of metal adjacent the periphery of an axially vertical mold. These expedients, however, have not afforded wholly satisfactory reduction of inclusions in the outer portion of cast billets, or have suffered from other disadvantages. In particular, it has been difficult to produce fluid circulation electromagnetically within a mold, because the coils through which electric current is passed to cause such circulation must be disposed externally of the electrically conductive wall of the mold, although (as described in U.S. Pat. No. 3,693,697, issued Sept. 26, 1972 to Alexander A. Tzavaras, one of the applicants herein) effective circulation can be produced electromagnetically in the molten core of the portion of a billet that projects beyond a mold, for control of solidification conditions within that portion.

SUMMARY OF THE INVENTION

It is an object of the present invention to provide improvements in continuous casting procedures of the type wherein metal to be cast is delivered to a mold through a submerged shroud. A further object is to provide such improvements for reducing the occurrence of inclusions in a cast body and especially in the outer portion thereof corresponding to the locality of the solid-liquid interface within the mold. Another object is to provide new and improved apparatus for performing such procedures.

Stated broadly, the invention is applicable to the continuous casting of metal wherein liquid metal is poured through a submerged shroud into a cooled mold through which the metal moves in a first direction with an outer solidifying shell defining a solid-liquid interface within the mold and which is lined with electrically conductive material, the shroud having a closed bottom and delivering metal to exit outwardly into a region located in an upper portion of the mold. In procedures in accordance with the invention, the metal is poured through the shroud so as not to interfere with the slag layer floating in contact with the metal substantially upstream of the bottom region of the shroud.

In such procedures, the invention contemplates electromagnetically producing circulation of the liquid metal in the mold by passing alternating current, preferably in one or more generally horizontal, helical paths, running along the mold between approximately the slag-metal interface and a locality situated downstream of the outward exit of metal from the shroud. The alternating current is supplied to have at least two successively different phases in longitudinally successive regions thereby to provide circulation of the liquid metal in a second direction generally opposite to the aforementioned first direction along the solid-liquid interface within the mold from the last-mentioned locality to the slag layer, and generally in the first direction along the outer surface of the shroud. More particularly, the alternating current is supplied so as to establish and maintain a field for moving the liquid metal along the solid-liquid interface within the mold (i.e. in the aforementioned second direction) as a laminar flow at a flow rate of not more than 35 cm./sec., preferably not more than about 25 cm./sec. Further, the alternating current is supplied at a frequency sufficiently high to move the metal in the described circulation and sufficiently low that effective metal-moving power is transmitted despite attenuation by the conductive lining such that electromagnetically induced metal flow acts to positively sweep nonmetallic inclusions entrained in the outflow from the shroud along the solid-liquid interface in spaced relation thereto toward the slag layer.

In this procedure, the electromagnetically created flow of molten metal, directed toward the slag layer along the solid-liquid interface within the mold, both promotes transport of inclusions (introduced with the metal delivered through the shroud) toward the slag layer, and also, very significantly, serves as a flowing barrier, i.e. as a shield or screen, to prevent these inclusions from reaching the solid-liquid interface, where they would tend to become entrapped in the mushy solidifying metal. That is to say, not only the direction of the flow, but also the fact that it keeps the inclusions spaced away from the interface as they move toward the slag layer, is important for minimizing or preventing entrapment of inclusions in the metal body being cast. In addition, the direction of the flow adjacent the periphery of the slag layer (i.e. that part of the slag layer which is closest to the solid-liquid interface) inhibits entrapment of slag material. Thus the described procedure results in significant reduction of inclusions in the cast body and enhances surface quality of the cast body.

Especially important is the provision and maintenance of the flow of molten metal as a laminar flow along the solid-liquid interface, with a flow rate of not more than 35 cm./sec. and preferably not more than about 25 cm./sec. If the flow rate is excessive, particularly adjacent the slag layer, or if the flow along the interface is turbulent rather than laminar, the desired results are not achieved, and mixing of slag and metal occurs leading to unacceptable levels of slag entrapment in the produced ingot.

Maintenance of the requisite laminar flow along the interface requires that the molten metal flow be substantially uniform in rate and direction around the entire periphery of the mold at any given level therein, i.e. within the region in which the flow is produced. In specific embodiments of the invention, these conditions are provided by a combination of appropriate selection of the exciting frequency with use of a mold having a copper wall (commonly termed a "copper liner") and a particular type of exciting coil structure surrounding the wall and characterized by absence of spacing between successive coil turns and by a surrounding assembly of yoke members. The yoke members serve to concentrate the field strength within the copper liner and are found to cooperate therewith to produce a highly advantageous flow condition along the interface. Moreover, in the case of a mold of square or rectangular cross section, appropriate arrangement of the yoke members provides desired uniformity of field strength around the mold periphery, which is otherwise difficult to attain with molds of such configuration. The invention, in its apparatus embodiments, contemplates the combination of copper mold wall, coil and yoke members for producing a laminar flow along the solid-liquid interface within the mold.

Further features and advantages of the invention will be apparent from the detailed description hereinbelow set forth, together with the accompanying drawings.

DETAILED DESCRIPTION

Figure 1:
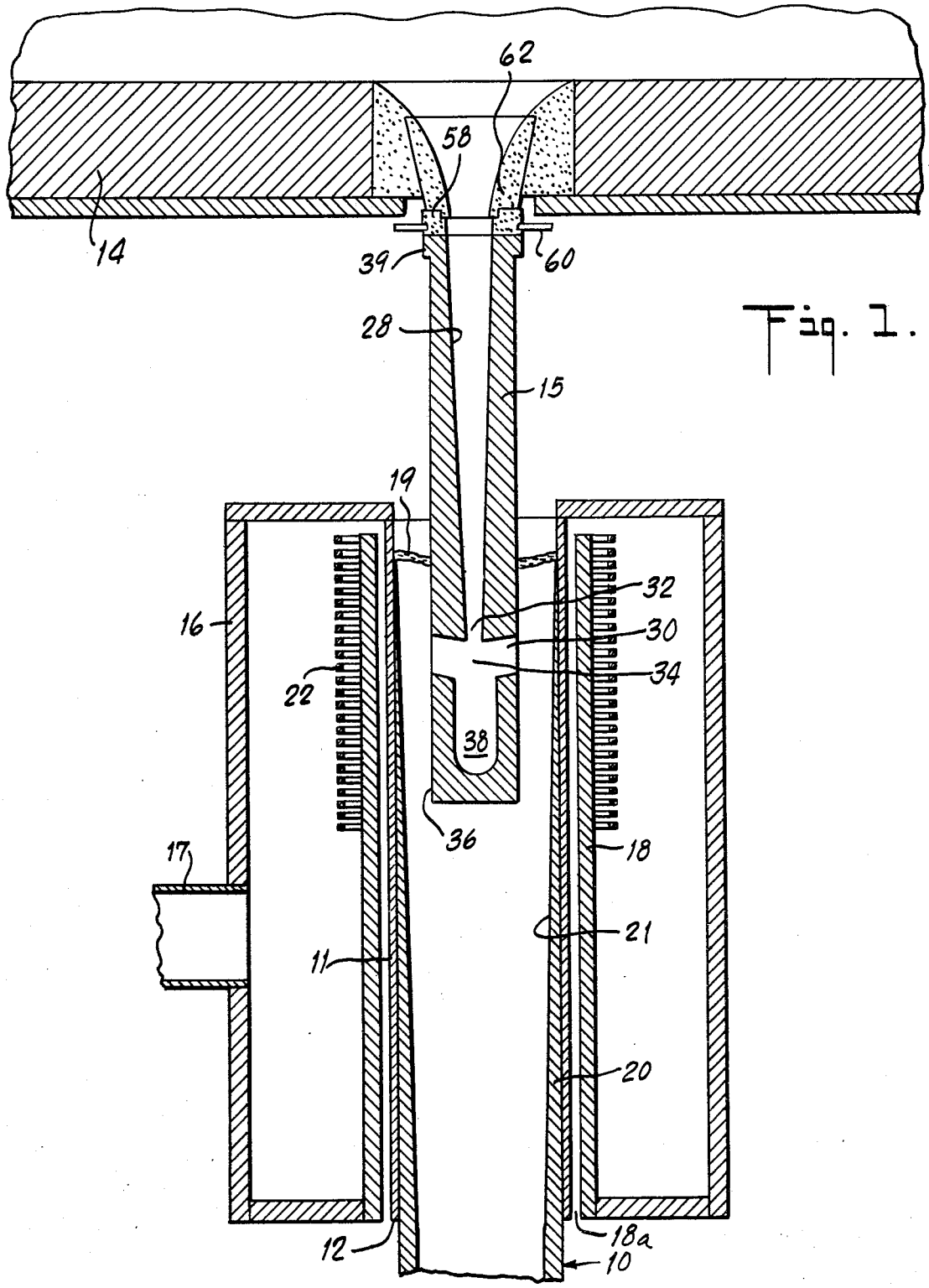
FIG. 1 is a simplified and somewhat schematic sectional elevational view of representative apparatus with which the procedure of the invention, in an illustrative embodiment, may be practiced.

For purposes of specific illustration, the invention will be described with reference to the continuous casting of a steel billet 10 (FIG. 1) in an axially vertical mold 11 having an open lower end 12 through which the billet is progressively advanced, i.e. in a downward direction, as casting proceeds, while molten steel is progressively supplied to the interior of the mold as from a tundish 14 by means of a submerged shroud 15. In common with conventional arrangements for continuous casting, the mold 11 may comprise a copper wall defining a casting region conforming in cross section to the desired circular, square, rectangular or other cross-sectional shape and dimensions of the billet to be cast. Outwardly of the mold 11, there is provided a cooling jacket 16 through which a coolant liquid such as water is circulated to chill the mold; the liquid, supplied to the jacket through a conduit 17, flows downwardly through a space defined between the mold wall and a surrounding baffle portion 18 of the jacket made of low-conductivity material, e.g. nonmagnetic stainless steel, to exit through a downwardly opening slit **18*a* surrounding the open lower end 12** of the mold. Appropriate structures and techniques for performing such aspects of the operation as start-up, cooling of the emergent billet below the mold, and progressive controlled descent of the billet from the mold during casting, may be generally conventional as will be apparent to those skilled in the art and accordingly need not be described in detail. It will be understood, of course, that the foregoing features are merely illustrative of one type of casting operation with which the present invention may be practiced.

In the described casting operation, molten metal is delivered through the shroud 15, at a rate to maintain the mold filled with metal to a substantially constant level in the upper portion of the mold, i.e. spaced above the submerged discharge ports of the shroud; a layer 19 of slag floats on the surface of the molten metal in the mold. Solidification of the metal, promoted by the chilling effect of the supplied coolant, commences at the periphery of the body of metal within the mold and proceeds progressively inwardly (as the metal advances downwardly) toward the axis thereof, providing a solid external shell 20 for the billet at and below the lower end of the mold, although the core of the billet remains molten for a substantial distance below the mold. Thus, in the body of metal within the mold, there is a solid-liquid interface or solidification front 21 which tapers gradually inwardly (in a downward direction) through and below the mold. Typically, at the region of molten metal delivery in the mold, the position of this interface corresponds to a locality fairly close to the periphery of the ultimately cast ingot.

The molten metal as delivered through the shroud unavoidably contains inclusions such as solid particles of aluminum oxide, which are usually carried in the flow of metal exiting from the shroud discharge ports. It is desirable that these inclusions rise to and accumulate in the slag layer 19, so that they will not contaminate the cast billet. At the solid-liquid interface 21, however, there is a "mushy zone" of solidifying metal which tends to entrap and retain any solid inclusions that come into contact with it. Therefore, to the extent that inclusions entering the mold from the shroud are carried to the mushy zone by the incoming metal flow, they are very likely to become entrapped at the interface 21 rather than rising to the slag layer; material of the slag layer may also become entrapped as inclusions at the interface. The entrapped inclusions remain in and contaminate the cast billet, at the locations (relative to the billet axis) at which they are initially entrapped, undesirably impairing the machinability of the billet and especially the outer portion thereof (which is commonly subjected to machining) where there inclusions are found.

The present invention, as employed in a casting operation of the above type, embraces procedures having particular effectiveness for minimizing entrapment of such inclusions. Thus, in accordance with the invention, electromagnetic induction stirring coils 22 are provided in surrounding relation to the upper portion of the mold 11 and alternating current is passed therethrough to provide a particular advantageous flow pattern in the molten metal in that region of the mold. For purposes of illustration, the invention is described (with reference to FIG. 1) in combination with certain other features of advantage for continuous casting operation, which other features (as likewise their combination with electromagnetically created circulation) are disclosed and claimed in the copending patent application of Alexander A. Zavaras, Robert Sobolewski, and Cecil B. Griffith, three of the applicants herein, Ser. No. 571,016, filed Apr. 22, 1975, now U.S. Pat. No. 4,042,007 for Continuous Casting of Metals and assigned to the same assignee as the present application. These other features include a shroud of special construction and the injection of an inert gas into the incoming stream of molten metal at an upstream locality in the shroud. Each of these features, including the electromagnetically created circulation of the present invention, may be employed individually, or (with special advantage) in combination with either or both of the other features, to achieve the desired object. These features will now be described in detail in exemplary and presently preferred embodiments.

Electromagnetically Created Circulation

For the practice of the present method with the apparatus of FIG. 1, the helical coils 22 are disposed within the cooling jacket 16 in proximate surrounding coaxial relation to the upper portion of the mold 11, i.e. that portion of the mold through which the shroud 15 extends. These coils provide generally horizontal helical paths for alternating current, running peripherally around the mold between approximately the slag-metal interface and a locality situated downstream of the outward exit of metal from the shroud. The coils 22 are energized by a source of alternating current potential (not shown) such that the excitation of different sections or portions of the coils in longitudinally successive regions differs successively in phase in a predetermined manner as will be readily understood. Any number of phases (i.e. two or more) may be employed for the excitation. What is desired is a moving magnetic field which causes a flow of metal as shown by arrows 24 in FIG. 3.

In this regard, it will be appreciated that electromagnetic stirring principles as employed in connection with the melting and refining of molten metal are well known, and that the present invention involves a specific application of these general principles. Thus, stated in general, the stirring mechanism involves the development of eddy currents within the molten metal by a varying magnetic field, which eddy currents themselves set up magnetic fields that interact with the applied magnetic field to cause movement of the molten metal. By using polyphase excitation of portions or sections of the coils 22 located at different positions along the mold axis, pulses of motive force are given to the molten metal progressively from section to section in the desired direction, so that the metal is caused to flow continuously upward along its outermost regions (immediately adjacent the solid-liquid interface), in effect parallel to the axis of the coils. Accordingly, the flow of molten metal is as shown by the arrows 24, namely, sweeping upwardly over the solid-liquid interface within the mold, and downwardly along the outer surface of the shroud.

More particularly, the method of the invention involves passing alternating current through the coils, i.e. current having at least two successively different phases in longitudinally successive regions of the coils, at a frequency sufficiently high to move the metal in the described circulation and sufficiently low that effective metal-moving power is transmitted despite attenuation of the conductive metal wall or lining of the mold 11. As will be understood, the copper mold wall significantly attenuates stirring power, but the extent of such attenuation is inversely related to frequency, as indicated by the following table which sets forth experimentally determined values for percentage attenuation and percentage transmittal of stirring power through a 0.250-inch-thick copper mold wall having electrical conductivity of 99% IACS at frequencies ranging from ½ to 60 Hertz, using three-phase current:

| Frequency (Hz) | % Attenuation | % Transmittal |
|---|---|---|
| ½ | 0 | 100 |
| 10 | 38 | 62 |
| 15 | 57 | 43 |
| 20 | 63 | 37 |
| 25 | 71 | 29 |
| 30 | 73 | 27 |
| 35 | 75 | 25 |
| 60 | 85 | 15 |

As will be apparent from the foregoing table, if the frequency of the supplied alternating current is too high, the attenuation is so great that impracticable input levels would be required to achieve effective metal stirring within a mold. On the other hand, it is found that even at substantial input power levels, effective metal circulation is not achieved if the frequency is excessively low. It is preferred to use a frequency of less than 60 Hz in the present method, an especially preferred and effective frequency range for the supplied alternating current being between about 10 and about 44

Hz, and an especially preferred range being about 10 to about 25 Hz. Within such range, the frequency is sufficiently high and the attenuation adequately low to permit attainment of the desired circulation at economical levels of supplied power.

Figure 3:
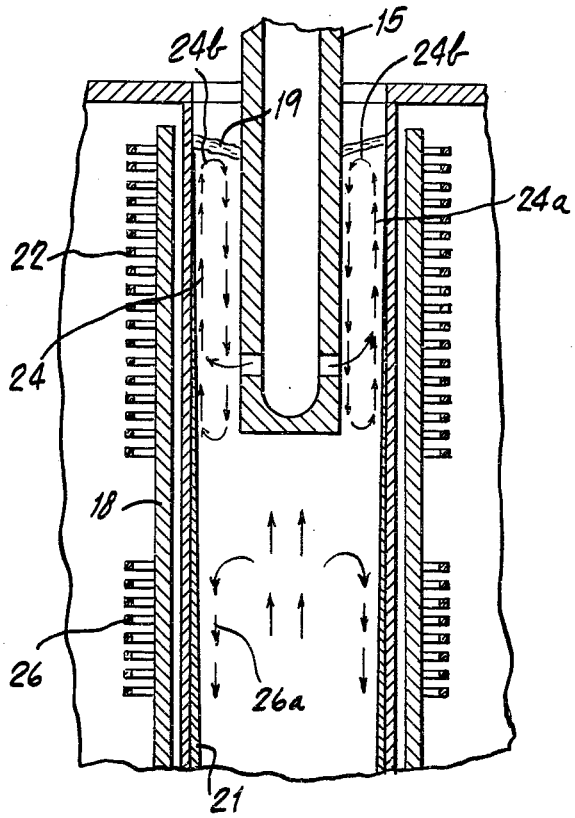
FIG. 3 is a view similar to FIG. 2 showing only the flow pattern caused by electromagnetically created circulation, and further illustrating provision of a second region of electromagnetically created circulation at a downstream locality in the mold.

FIG. 3 illustrates the circulation pattern created in the upper portion of the mold by the described induction stirring. In this pattern, the upward flow of metal (represented by arrows 24a) along the solid-liquid interface not only promotes upward flow of metal exiting from the shroud (as desired to carry entrained inclusions upwardly to the slag layer) but also constitutes a barrier that effectively prevents inclusions from reaching the mushy zone at the solid-liquid interface, where they would tend to become entrapped even when moving upwardly. Thus the inclusions, during their upward transport from the shroud exit ports to the slag layer, are kept in spaced relation to the interface by the sweeping upward current of molten metal represented by arrows 24a.

In addition, the electromagnetically created flow pattern inhibits entrapment of material of the slag layer at the solid-liquid interface. By promoting flow of hot introduced metal toward the slag layer, the described circulation helps to maintain the slag layer in a desirably hot and fluid condition. At the same time, the direction of metal flow at the locality where the slag layer most closely approaches the solid-liquid interface (represented by arrows 24b) tends to sweep slag material away from the upper extremity of the interface where it is most likely to become entrapped in a solidifying front.

In order to achieve the above-described results, it is essential that the upward flow of molten metal along the solid-liquid interface within the mold be a laminar flow, and that the flow rate along the interface be not more than 35 cm./sec. and preferably not more than about 25 cm./sec. Thus the performance of the metal-circulating step as a step for producing and maintaining such laminar flow constitutes a particularly important feature of the invention. To this end, the rate as well as the direction of the flow around the entire periphery of the mold at any given level must be substantially uniform. Nonuniformity results in turbulence; if the flow is turbulent, inclusions will not be transported properly to the slag layer, while if the flow is excessively rapid (especially adjacent the slag layer), mixture of slag with the metal being cast will occur, rather than the desired separation of the metallic and nonmetallic phases.

As stated, the location of the coils 22 should extend upwardly about to the slag-metal interface and downwardly to a locality below the shroud exit ports in order to ensure provision of the sweeping upward flow of metal along interface 21 through the entire region in which introduced inclusions and/or material of the slag might tend to become entrapped. It is presently preferred that the coils, in the embodiment of FIG. 1, extend from a level about two or three inches below the metal level in the mold to a point about four to five inches or more below the lower end of the shroud 15.

Although the coils 22 are shown in FIG. 1 in combination with other features including the special shroud construction and inert gas injection arrangement further described below, the foregoing electromagnetically created circulation in the upper part of the mold may be performed independently of use of these other features, as illustrated in FIG. 3.

Also shown in FIG. 3 is a second set of helical coils 26, again coaxially surrounding the mold 11 but spaced below the coils 22. The coils 26 may be employed if desired to provide, by induction stirring, further forced circulation of molten metal within the lower part of the mold, i.e. entirely below the shroud and adjacent the mold outlet end.

Specifically, coils 26 are supplied with alternating current from a source (not shown) again such that the excitation of different portions of these coils in longitudinally successive regions differs successively in phase, the arrangement being such as to produce metal circulation in the paths indicated by arrows 26a in FIG. 3, i.e. downwardly adjacent the solid-liquid interface and then upwardly at the center of the mold. The considerations discussed above with reference to the selection of frequency for the current supplied to coils 22 are equally applicable to the current supplied to coils 26 since, as before, the conductive mold wall attenuates stirring power in a frequency-related way.

The described circulation created electromagnetically by passage of polyphase alternating current through the coils 26 aids in preventing defects in that part of the billet which solidifies within the mold and additionally serves to prevent sudden changes in the condition of the mushy zone at the solid-liquid interface as the billet emerges from the lowest part of the mold (where heat transfer is relatively inefficient) and enters the submold region where (in accordance with usual continuous casting practice) it is chilled with substantially enhanced efficiency of heat transfer by direct contact with sprays of a coolant such as water (not shown).

Figure 4:
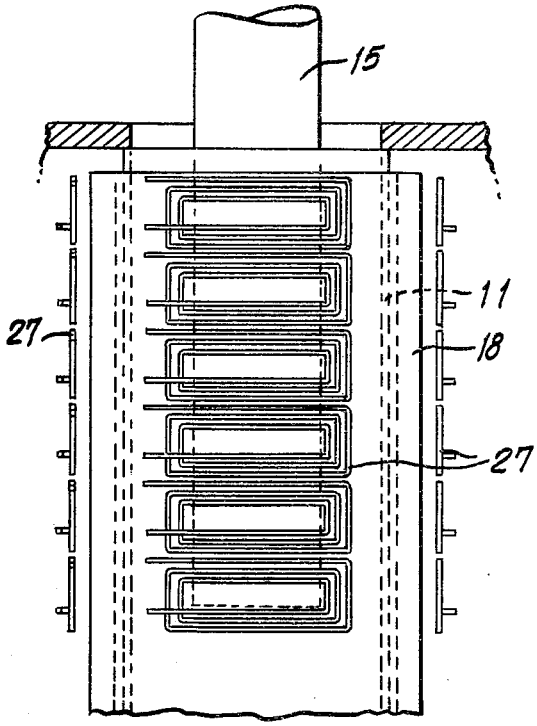
FIG. 4 is a simplified elevational view of a mold similar to that of FIG. 1, showing an alternative arrangement of coils for producing electromagnetic circulation e.g. in the apparatus of FIG. 1.

FIG. 4 illustrates, in somewhat simplified form, an alternative coil arrangement for the practice of the present invention. The copper mold 11, the submerged shroud 15, and nonmagnetic stainless steel water cooling jacket 18 may be identical to the corresponding elements shown in FIG. 1; the cooling jacket, as illustrated, presents four flat vertical faces arranged on a square plane. In place of the helical coil 22 of FIG. 1, however, the apparatus of FIG. 4 includes four sets of so-called pancake-type induction stirring coils 27 respectively disposed adjacent the faces of the cooling jacket 18. Each of these coils, in the form shown, defines a plurality of horizontal current paths lying in a common vertical plane parallel to the plane of the adjacent jacket face, and distributed vertically over the same region (adjacent the mold) as the coils 22 of FIG. 1. Passage of polyphase alternating current through these pancake coils 27, from a suitable source (not shown), and in observance of the conditions described above with reference to FIG. 1, produces the pattern of molten metal circulation shown in the upper portion of FIG. 3, i.e. essentially the same molten metal flow pattern within the mold as is produced with the coils 22.

Figure 5:
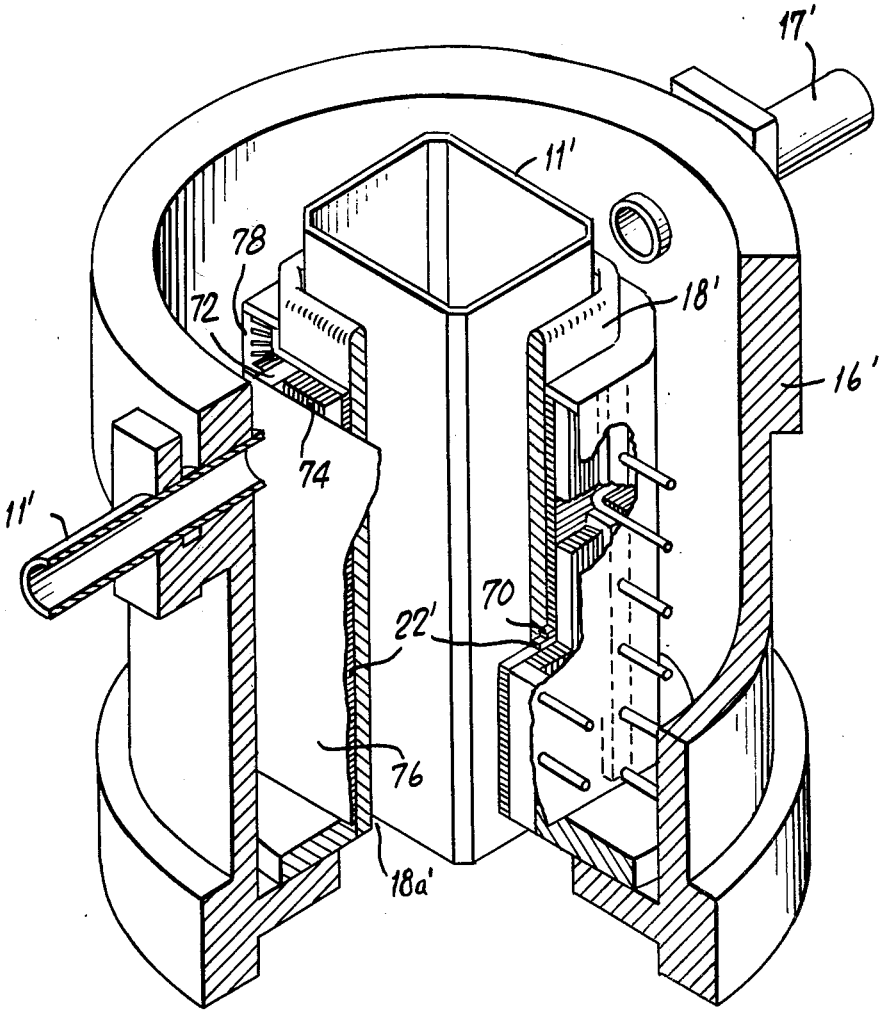
FIG. 5 is a detailed perspective view, partly broken away, of casting apparatus of the general type shown in FIG. 1, embodying the invention in a particular form.

Referring to FIG. 5, the mold there shown comprises an axially vertical copper liner 11' shaped for casting an ingot of square cross section and disposed within a cooling jacket 16' to which water is supplied by conduits 17' for downflow through the annular space defined between the liner 11' and a surrounding baffle portion 18' of the jacket, i.e. to cool the liner, the water exiting through a downwardly opening slit 18a' at the lower end of the annular space. It will be understood that in common with the casting apparatus schematically illustrated in FIG. 1, the apparatus of FIG. 5 is provided with a submerged shroud of the general type represented at 15 in FIG. 1 for delivering molten metal to the interior of the liner 11', although in FIG. 5 the shroud is omitted for simplicity of illustration.

Closely surrounding the baffle portion 18' in coaxial relation to the liner 11' is an induction coil generally designated 22' extending from an upstream locality adjacent the level at which the slag layer is maintained within the mold to a downstream locality substantially below the shroud discharge ports. Electrically, the coil 22' is designed as a typical polyphase induction stirrer assembly with six individual phase coils connected to a three-phase low-frequency power supply. Two individual phase coils of this assembly are connected to each phase of the power supply and are wired electrically with their polarities reversed to provide a six-phase induction stirring system. The coil is energized in a phase sequence to move molten metal within the mold upwardly along the solid-liquid interface adjacent the mold periphery and downwardly adjacent the center of the mold.

The coil 22' is constituted of a large plurality of turns of rectangular copper tubing 70, insulated with a very thin coating, e.g. polytetrafluoroethylene, but otherwise in contact with each other such that there is no spacing between adjacent turns or between adjacent phase coils. At intervals around the periphery of the mold, the coil is supported by posts 72 and, except at the locations of the posts, is backed by magnetic yokes 74 completely around the mold. The yokes 74, which are disposed on the side of the coil away from the mold, are constituted of silicon steel laminations extending vertically from the upper extremity to the lower extremity of the coil. The entire coil assembly is protected against water infiltration into the coil turn areas by encapsulation in an epoxy resin. The encapsulated coil is encased in a stainless steel outer shell 76 for protection against the force of cooling water flowing through the jacket 16'. A flow of cooling water for the coil assembly itself is separately supplied thereto.

In the described assembly, the magnetic yokes 74 serve to concentrate the magnetic field strength within the copper liner, providing an increase in field strength within the liner (i.e. as compared to the field strength when the yokes are absent) of as much as 45% at the frequencies employed in the practice of the present invention. This increase in efficiency permits operation at significantly lower coil voltages than would otherwise be required. It will be appreciated that such low voltage operation is important for avoidance of arcing between adjacent turns of the coil 22', especially since the turns of the coil are in contact with each other. It is found that the absence of spacing between adjacent coil turns provides the smoothest possible gliding field, and consequently the smoothest possible flow of molten metal, within the liner 11'.

In addition, the yokes cooperate with the specific described coil design and with the use of a copper liner to cause the molten metal within the mold to flow along the solid-liquid interface as a very collimated band of rising metal which is particularly effective as a barrier to inclusions migrating toward the solidification front from the shroud discharge ports. The width of the collimated upward flow of metal appears to be independent of frequency at least through the range of frequencies from 10 Hz to 44 Hz. The described use of a copper liner is, however, important for attainment of this desired flow condition, it being found that when a copper liner is not used, the width of the rising metal stream (e.g. at an exciting current frequency of about 25 HZ) is at least doubled, and the stream exhibits an overlapping wave motion.

The yoke members also enable provision and maintenance of substantial uniformity in the rate of upward flow of metal around the entire periphery of the mold at any given level therein, even if the mold is of square or rectangular configuration. Stated in general, induction stirring in a mold having right angle corners, utilizing a surrounding coil of configuration conforming to the mold, tends to be characterized by turbulent flows in the corners owing to unequal field strengths in the corners. Such uneven flow velocities would cause local turbulence and would destroy the desired flow patterns for the purposes of the present invention. Since the presence of the yoke members tends to enhance field strength, selective spacing of yoke member laminations adjacent the corners of a right-angled coil (i.e. a coil surrounding a square or rectangular mold) serves to control the field strength at and adjacent the corners in a manner providing the desired uniformity of field strength and resultant flow rate entirely around the mold periphery. Such selective spacing of laminations is represented at 78 in FIG. 5.

By way of still further illustration, in a specific example of casting apparatus of the type illustrated in FIG. 5, arranged to provide an upward sweep of molten metal within the mold at a velocity of less than 25 cm./sec. from a level 12–16 inches below the shroud discharge ports to the slag layer, the coil 22' had 102 turns and was backed by silicon steel yoke laminations each 0.025 inch thick and ¾ inch wide and 19½ inches long. The copper mold liner used in this example had an electrical conductivity of 99% IACS. At a frequency of 21 Hz with a coil current of 600 amp, the magnetic field strength B was less than or equal to about 250 Gauss. With this energization, the metal flow rate along the solid-liquid interface within the mold was about 22 cm./sec., and the flow thus produced was smoothly uniform without excessive whirlpooling or metal turbulence. The width of the rising stream of metal along the interface was about 10–12 mm. For further protection against excessive whirlpooling or turbulence at the slag interface, the coil was so disposed that its upper extremity was about 2–3 inches below the level of molten metal in the mold during normal operation.

The structure illustrated in FIG. 5 and the described energization of a particular assembly of that type represent specific embodiments of the method and apparatus of the present invention for providing the desired laminar flow of metal at appropriate velocity to prevent introduced nonmetallic inclusions from reaching the solid-liquid interface within the mold and to transport these inclusions into the slag layer without causing material of the slag layer to contaminate the ingot being cast. It will be appreciated that somewhat higher flow rates can be tolerated at the level of the shroud discharge ports than at the upstream extremity of the flow immediately adjacent the slag layer, where avoidance of turbulence or excessive flow velocity is particularly critical. Thus the coil employed may be such as to provide a decrease in stirring intensity in an upstream direction from the center of the coil to the upper end thereof. Such decrease is inherent in coils having contiguous turns from end to end. If desired, however, as an alternative to the coil arrangement described above with reference to FIG. 5, there may be employed a coil and/or a coil energizing arrangement as disclosed in U.S. Pat. No. 3,995,678 issued Dec. 7, 1976 to Alexander A.

Zavaras and Robert E. Ryan (two of the applicants herein), providing for gradual decrease of stirring intensity from a central locality in the coil toward at least one end thereof.

Shroud

The shroud 15 shown in FIG. 1 is an axially vertical conduit structure connected at its upper end to the tundish 14 and projecting downwardly therefrom into the upper portion of the interior of the mold 11, being disposed in coaxial relation to the mold. An axial bore 28 formed in the shroud, communicating at its upper end with the interior of the tundish and at its lower end with the interior of the mold through a plurality of lateral exit ports 30, conducts molten metal from the tundish down into the mold. As will be understood, the shroud may be an effectively integral body fabricated of a material conventionally used for shrouds for continuous casting operations.

The bore 28 of the shroud tapers downwardly from its upper, inlet end to its lower or outlet end immediately above the exit ports so as to form a downwardly opening nozzle 32. Immediately below the nozzle is a plenum 34 from which the ports 30 open laterally, and immediately beneath the plenum is a terminal portion 36 of the shroud defining a well 38 opening upwardly toward and axially aligned with the nozzle. This well has an internal diameter greater than that of the nozzle, and a vertical dimension or depth equal to at least several times the diameter of the nozzle. The exit ports open obliquely upwardly, being preferably disposed several inches below the metal level in the mold.

More particularly, in a preferred construction the exit ports are oriented with their geometric axes slanting upwardly at an angle of about 11° to about 15° to the horizontal, and the well depth is equal to at least about 4½ times the internal diameter of the outlet end of the nozzle. Preferably, the ratio of well diameter to nozzle diameter is at least about 1.5:1. In an illustrative specific example of dimensions, for a shroud having an overall length of 34 inches and a uniform outer diameter of 4¾ inches (ignoring the enlarged top flange 39), the bore tapers from a diameter of 2¼ inches at the upper end to a diameter of 1¼ inches at the nozzle outlet end, and the well has an inner diameter of 2¼ inches. The exit ports, each 2 inches in diameter, have their centerlines disposed (at the outer surface of the shroud) 25 inches below the top of the shroud and about 6 to 7 inches below the metal level in the mold, while the well terminates (internally) 32½ inches below the top of the shroud.

In this shroud structure, the tapering nozzle directs the incoming metal down into the well, which defines a mixing zone and holding chamber to prevent violent splashover of molten metal into the mold. This zone also desirably acts to allow inclusions in the molten metal to aggregate before entering the mold thereby permitting them to rise faster into the slag layer. Owing to the upward inclination of the ports, the outward flow of metal therethrough is directed somewhat upwardly (i.e. toward the slag layer, and away from the direction of casting), so that the inclusions tend to be carried up to the slag layer where they remain. Also, the upward flow of introduced hot metal heats the slag layer to maintain its fluidity, thereby reducing the likelihood of entrapment of inclusions from the slag layer at the solid-liquid interface of the metal in the mold. The combined effect of the tapered nozzle, well, and upwardly slanting ports is particularly effective in realizing this upward direction of metal flow in the mold.

Figure 2:
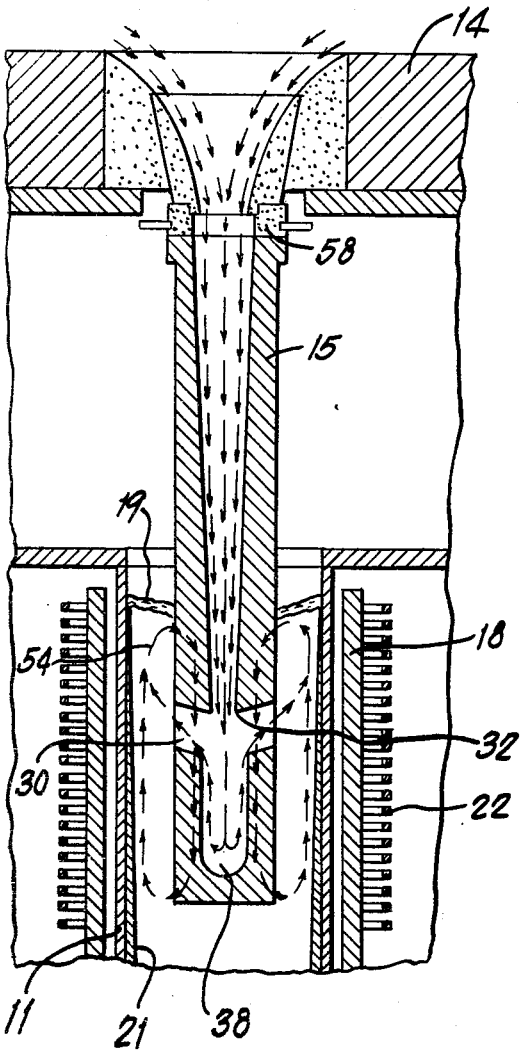
FIG. 2 is a simplified view, similar to FIG. 1, showing metal flow patterns in the FIG. 1 apparatus.

This described shroud is used with special advantage in conjunction with the provision of electromagnetically created circulation as described above, and cooperates therewith for attainment of reduced or minimized entrapment of inclusions in the cast billet. The metal flow pattern produced by such cooperation is represented by arrows 54 in FIG. 2. In addition, delivery of metal with this shroud is also advantageously combined with the feature of injecting inert gas, now to be described.

Inert Gas Injection

For injection of an inert gas into the molten metal flowing through the shroud 15, a porous ceramic insert 58 is disposed for contact with the flowing metal at or adjacent the junction of the upper end of the shroud with the tundish 14, and inert gas (e.g. argon ) is supplied to insert 58 through one or more conduits 60 under sufficient pressure to force the gas into the metal descending through the shroud. As shown in FIG. 1, the insert 58 may be in the form of a ring, having an external steel jacket (not shown), mounted between the outlet 62 of tundish 14 and the flange 39 at the upper edge of the shroud 15, and having its porous inner surface exposed to the flow of molten metal entering the shroud.

The insert is disposed at or near the top of the shroud, i.e. sufficiently far above the exit ports thereof to enable the gas to disperse through the downwardly flowing metal in the form of fine bubbles before exiting into the mold. Thus, in the example of dimensions given above for the structure of FIG. 1, the gas is injected into the metal about 25 inches above the center line of exit ports 30.

As soon as these bubbles exit through the ports 30, they rise rapidly to the surface of the metal within the mold. The rising bubbles serve as a vehicle for upward transport of inclusions such as aluminum oxide particles, which are not wetted by molten steel and are therefore readily capable of being carried by the bubbles. The provision of a plethora of inert gas bubbles, through injection as described above, accordingly promotes delivery of these inclusions into the slag layer as desired. In addition, the rising bubbles contribute to the desired upward flow of freshly delivered metal.

A further advantage of the described inert gas injection, as used either alone or in combination with the pressure conditions created by the tapered-nozzle shroud of FIG. 1 (i.e. when a shroud of that structure is employed together with gas injection), resides in the provision of pressure within the shroud that is at least slightly greater than ambient atmospheric pressure. This pressure differential effectively prevents aspiration of air, e.g. at the junction between the shroud and tundish, which would tend to cause undesirable oxidation in the metal.

To afford, for the bubbles within the mold, an upward path sufficiently long to enable them to provide the desired effect of upward transport of inclusions (and also to prevent disturbance of the slag layer by discharge of bubbles too close to that layer), the exit ports of the shroud should be disposed substantially below the metal level in the mold, for performance of the described injection of inert gas. A distance of six or seven inches between the metal level and the centerline of the ports, to which reference is made in the aforementioned example of dimensions, is illustrative of a suitable arrangement for this purpose.

By the described injection feature, the gas is (as stated) dispersed as fine bubbles through the molten metal in the shroud, and it is this dispersion that permits attainment of the described results. Conveniently, the gas employed is argon, supplied at a rate of e.g. several cubic feet per hour. Such gas injection, alone (i.e. using a generally conventional shroud), is found to produce significant reduction in the occurrence of inclusions in the ultimately cast billet. However, gas injection as herein contemplated is advantageously employed in conjunction with use of a shroud of the form shown in FIG. 1 (wherein the pressure drop created by the tapered nozzle cooperates with the supplied inert gas in maintaining a pressure greater than ambient within the shroud to prevent aspiration of air), and/or with provision of electromagnetically created circulation as described above, for cooperation in minimizing entrapment of inclusions at the solid-liquid interface of metal in the mold.

It is to be understood that the invention is not limited to the features and embodiments hereinabove specifically set forth but may be carried out in other ways without departure from its spirit.

We claim:

1. In the continuous casting of metal wherein the liquid metal is poured through a submerged shroud into a cooled mold through which the metal moves in one direction with an outer solidifying shell defining a solid-liquid interface within the mold and which is lined with electrically conductive material, said shroud having a closed bottom and delivering metal to exit outwardly into a region located in an upper portion of the mold, the procedure comprising pouring the metal through a slag layer in contact with the metal substantially upstream of said region, and electromagnetically circulating the metal in the mold by producing an alternating current field adjacent to the mold between approximately the slag-metal interface and a locality situated downstream of said outward exit, said alternating current being supplied to have at least two successively different phases in longitudinally successive regions to thereby provide circulation of the liquid metal in a direction generally opposite to said one direction along said solid-liquid interface from said locality to the slag layer and generally in said one direction along the outer surface of the shroud, said current being supplied at a frequency sufficiently high to move the metal in the described circulation and sufficiently low that effective metal-moving power is transmitted despite attenuation by said conductive lining; said field being produced as a field for establishing and maintaining circulation of the liquid metal as a laminar flow along said interface in said opposite direction from said locality to the slag layer, with the rate and direction of the flow being substantially uniform around the entire periphery of the mold at any given level therein, such that the electromagnetically induced metal flow acts as a flowing barrier to positively sweep nonmetallic inclusions entrained in the outflow from the shroud along said solid-liquid interface in spaced relation thereto toward the slag layer whereby removal of inclusions into the slag is promoted.

2. Procedure according to claim 1, wherein the field-producing step further comprises producing a field having a magnetic field intensity providing a flow rate of liquid metal along the interface of not more than 35 cm./sec.

3. Procedure according to claim 2, wherein said flow rate is not more than about 25 cm./sec.

4. Procedure according to claim 1, wherein the field-producing step comprises supplying said alternating current at a frequency of less than 60 Hz.

5. Procedure according to claim 1, wherein the field-producing step comprises supplying said alternating current at a frequency in the range of about 10 to about 44 Hz.

6. Procedure according to claim 1, wherein the field-producing step comprises passing alternating current in generally horizontal, helical paths running peripherally around the mold.

7. Procedure according to claim 6, wherein said mold is axially vertical, said one direction is vertically downward, and the current-passing step further comprises supplying said alternating current at a frequency in the range of about 10 to about 25 Hz.

8. Procedure according to claim 1, wherein the field-producing step comprises passing alternating current in generally horizontal paths distributed, in adjacent relation to the mold, over a region extending between a level about two to three inches below the slag-metal interface and a level at least about four to five inches downstream of the closed bottom of said shroud.

9. Procedure according to claim 1, wherein the mold has an open outlet end through which the metal moves after solidification of said outer shell, and further including the step of passing alternating current in further generally horizontal, helical paths running peripherally around the mold in a region spaced downstream of the first-mentioned paths and adjacent said mold outlet end, said last-mentioned alternating current being supplied to have at least two successively different phases in longitudinally successive regions to thereby provide circulation of the liquid metal generally in said one direction along said solid-liquid interface in said last-mentioned mold region and in a direction generally opposite to said one direction at the center of the mold in said last-mentioned region, said last-mentioned current being supplied at a frequency sufficiently high to move the metal in the described circulation and sufficiently low that effective metal-moving power is transmitted despite attenuation by said conductive lining.

10. Procedure according to claim 1, wherein said electrically conductive material comprises copper and wherein said current is supplied at a frequency sufficiently low for transmitting effective metal-moving power through the copper lining.

11. Continuous casting apparatus, comprising:

(a) an open-ended mold, having a copper lining, for casting metal while the metal moves in one direction through the mold with an outer solidifying shell defining a solid-liquid interface within the mold and while liquid metal having a slag layer floating thereon is maintained at a predetermined level in the upper portion of the mold;

(b) means for cooling the mold;

(c) a shroud for delivering liquid metal to the mold, said shroud having a closed bottom and opening laterally for discharging metal outwardly into a region located in an upper portion of the mold below said predetermined level;

(d) an induction coil surrounding said copper lining between localities respectively upstream and downstream of said region;

(e) means for supplying alternating current to said coil in at least two successively different phases in longitudinally successive portions of said coil thereby to produce, within the mold, a field for providing circulation of liquid metal in an upstream direction along the solid-liquid interface from said downstream locality to said predetermined level and in a downstream direction along the outer surface of the shroud; and (f) yoke means surrounding said coil on the side thereof opposite to said copper lining for cooperating with said copper lining to constitute the upstream-directed circulation of liquid metal along the interface as a collimated laminar flow, with the rate and direction of the flow being substantially uniform around the entire periphery of the mold at any given level therein.

12. Apparatus as defined in claim 11, wherein said coil comprises a plurality of turns of electrically conductive material with adjacent turns separated only by an electrically insulating coating applied to the external surfaces of the turns.

13. Apparatus as defined in claim 11, wherein said yoke means comprises yoke members each comprising a plurality of elongated laminations oriented parallel to the direction of metal movement within the mold.

14. Apparatus as defined in claim 13, wherein said laminations are distributed around the coil for providing substantially uniform field strength, within the mold, around the entire periphery of the mold.

* * * * *

UNITED STATES PATENT AND TRADEMARK OFFICE

CERTIFICATE OF CORRECTION

PATENT NO. : 4,200,137

DATED : April 29, 1980

INVENTOR(S) : Alexander A. Zavaras et al

It is certified that error appears in the above—identified patent and that said Letters Patent is hereby corrected as shown below:

Column 1, line 60, "case" should read -- cast --.

Column 5, line 23, "there" should read -- these --.

Signed and Sealed this

*Sixth* Day of *January 1981*

[SEAL]

*Attest:*

SIDNEY A. DIAMOND

*Attesting Officer*

*Commissioner of Patents and Trademarks*